US010334934B2

(12) United States Patent
Kudo

(10) Patent No.: US 10,334,934 B2
(45) Date of Patent: Jul. 2, 2019

(54) LIQUID COSMETIC CONTAINER

(71) Applicant: TOKIWA CORPORATION, Gifu (JP)

(72) Inventor: Saori Kudo, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 63 days.

(21) Appl. No.: 15/437,911

(22) Filed: Feb. 21, 2017

(65) Prior Publication Data

US 2017/0251786 A1 Sep. 7, 2017

(30) Foreign Application Priority Data

Mar. 1, 2016 (JP) ..... 2016-39017

(51) Int. Cl.
*B43K 8/00* (2006.01)
*A45D 34/04* (2006.01)
*B65D 41/02* (2006.01)

(52) U.S. Cl.
CPC ..... *A45D 34/042* (2013.01); *B65D 41/02* (2013.01); *A45D 2200/1072* (2013.01); *B43K 8/003* (2013.01)

(58) Field of Classification Search
CPC ..... B43K 8/003
USPC ..... 401/198, 199, 202, 205, 206, 207
See application file for complete search history.

(56) References Cited

U.S. PATENT DOCUMENTS 6,250,828 B1 6/2001 Liu
7,665,921 B2 * 2/2010 Liu ..... B43K 5/005 401/17
2008/0101844 A1 5/2008 Liu

FOREIGN PATENT DOCUMENTS

JP 3-41609 U 4/1991

OTHER PUBLICATIONS

Office Action issued in Korean family member Patent Appl. No. 10-2017-0024066, dated Feb. 1, 2018.
U.S. Appl. No. 15/440,314 to Saori Kudo, which was filed on Feb. 23, 2017.
Office Action issued in France Counterpart Patent Appl. No. 1751604, dated Feb. 8, 2019.

* cited by examiner

*Primary Examiner* — David J Walczak
*Assistant Examiner* — Joshua R Wiljanen
(74) *Attorney, Agent, or Firm* — Greenblum & Bernstein, P.L.C.

(57) ABSTRACT

A liquid cosmetic container includes a container main body, a leading tube and an intermediate core. The intermediate core is disposed in the container main body and the leading tube, and the intermediate core sends a liquid cosmetic material. A rear end of the intermediate core is positioned inside the housing portion, and a tip of the intermediate core projects from an opening at a tip of the leading tube. The leading tube has an inclination portion at a tip end side, and the inclination portion inclines with respect to an axis center of the container main body. Accordingly, the container does not hinder an application of a makeup while a mirror is seen, ensuring improving the usability.

9 Claims, 7 Drawing Sheets

LIQUID COSMETIC CONTAINER

TECHNICAL FIELD

The present invention relates to a liquid cosmetic container.

BACKGROUND ART

Conventionally, there has been known the following pencil-type application container. The application container houses an impregnated body into which cosmetic solution is impregnated in a long shaft tube. A rear end of an application bar made of a felt material or a similar material is inserted into the impregnated body. A tip of the shaft tube holds a tip end side part of the application bar, and the tip of this application bar is configured as an applying portion (for example, see Patent Literature 1). Using capillarity of the application bar, this application container absorbs up the cosmetic solution in the impregnated body and sends the cosmetic solution to the applying portion, thus ensuring an application of the cosmetic solution to an applied portion such as a skin.

CITATION LIST

Patent Literature

Patent Literature 1: Japanese Unexamined Utility Model Application Publication No. 3-41609

Technical Problem

To apply a makeup while a mirror is seen, the shaft tube of the pencil-type application container is hindrance. It is hard to see an application target and therefore the improvement has been requested.

An object of the present invention is to provide a liquid cosmetic container that does not hinder an application of a makeup while a mirror is seen and therefore an application target is seen easily, ensuring improving usability.

SUMMARY OF INVENTION

The liquid cosmetic container according to the present invention includes a container main body, a leading tube and an intermediate core. The container main body includes a housing portion to house a liquid cosmetic material therein. The leading tube is formed into a tubular shape. The leading tube is positioned on a tip end side of the container main body. The leading tube has a tube hole communicating with the housing portion. The intermediate core is disposed in the container main body and the leading tube. The intermediate core sends the liquid cosmetic material. A rear end of the intermediate core is positioned inside the housing portion. A tip of the intermediate core projects from an opening at a tip of the leading tube to form an applying portion. The leading tube has an inclination portion at a tip end side. The inclination portion inclines with respect to an axis center of the container main body. The intermediate core inclines following a tube hole on the inclination portion. An axis center of the tube hole on the inclination portion inclines in a direction identical to an inclination direction that an axis center of the inclination portion inclines with respect to the axis center of the container main body and further inclines with respect to the axis center of the inclination portion.

With this liquid cosmetic container, the leading tube on the tip end side of the container main body includes the inclination portion inclining to the axis center of the container main body. The container does not hinder an application of a makeup while a mirror is seen and therefore an application target is seen easily, ensuring improving usability.

Here, the inventor has found the following. When the inclined intermediate core is impregnated with the liquid cosmetic material, the intermediate core has a property of warping back so as to recover a state before the inclination. While the intermediate core inclines following the tube hole inside the inclination portion, the intermediate core warps so as to recover the state before the inclination in the applying portion, which projects from an opening on the tip of the leading tube. With thus warped applying portion, the axis center of the applying portion is displaced (becomes eccentric) from the axis center of the inclination portion. This makes the application difficult (makes a drawing difficult).

Therefore, the liquid cosmetic container according to the present invention employs the following configuration. The axis center of the tube hole on the inclination portion inclines in the direction identical to the inclination direction that the axis center of the inclination portion inclines with respect to the axis center of the container main body and further inclines with respect to the axis center of the inclination portion. When the applying portion, which projects from the opening on the tip of the leading tube, warps to attempt to recover an original state, the axis center of the applying portion approaches the axis center of the inclination portion. Accordingly, a user can provide an application while seeing a mirror with the axis centers of the inclination portion and the applying portion approximately matched mutually. This ensures further improving the usability.

Advantageous Effects of Invention

Thus, the present invention can provide a liquid cosmetic container that does not hinder an application of a makeup while a mirror is seen and therefore an application target is seen easily, ensuring improving usability.

DESCRIPTION OF EMBODIMENTS

Figure 1:
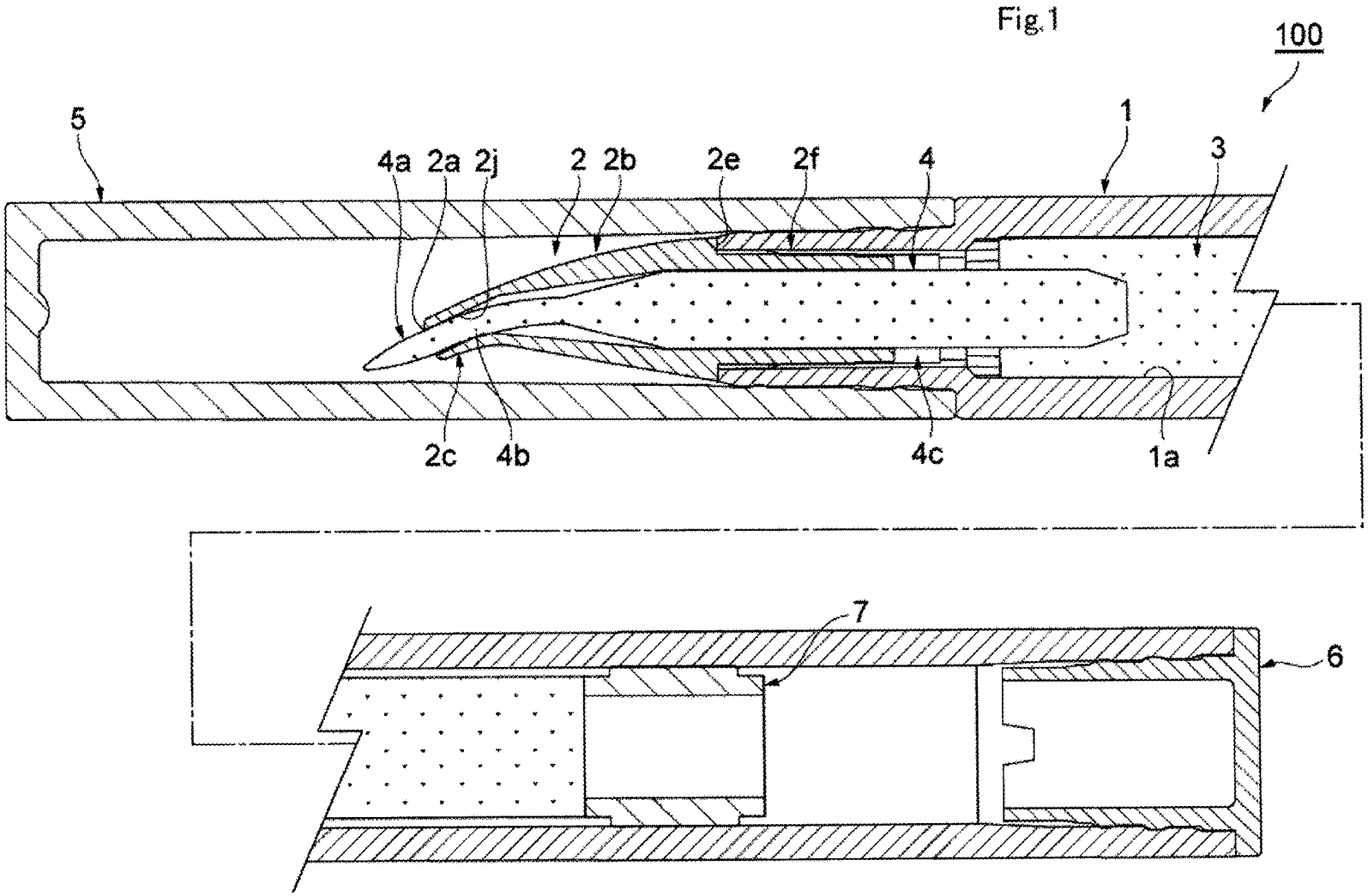
FIG. 1 is a vertical cross-sectional view illustrating a liquid cosmetic container according to an embodiment of the present invention.
Figure 2:
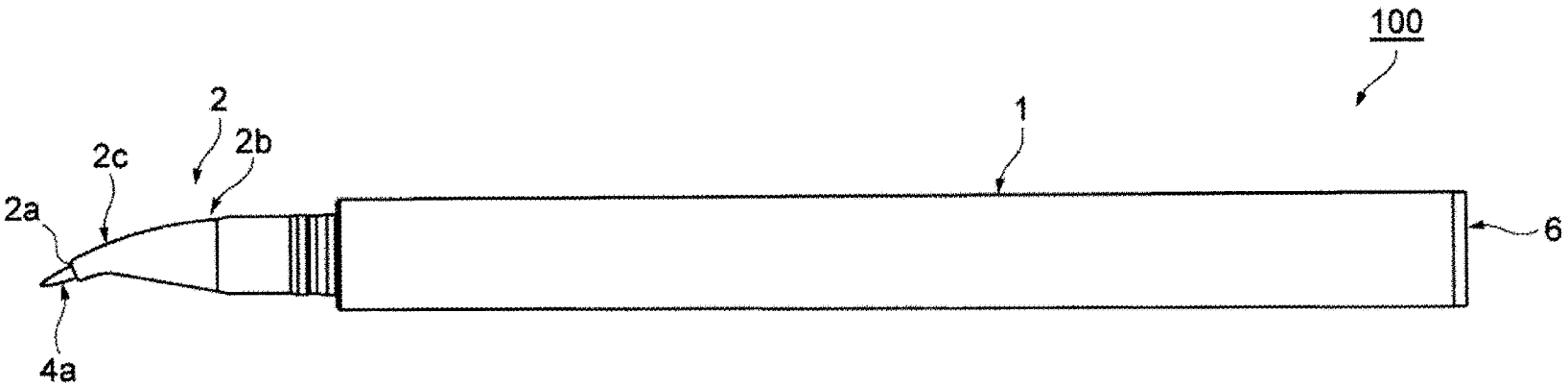
FIG. 2 is a front view illustrating a state of removing a cap from the liquid cosmetic container illustrated in FIG. 1.
Figure 5:
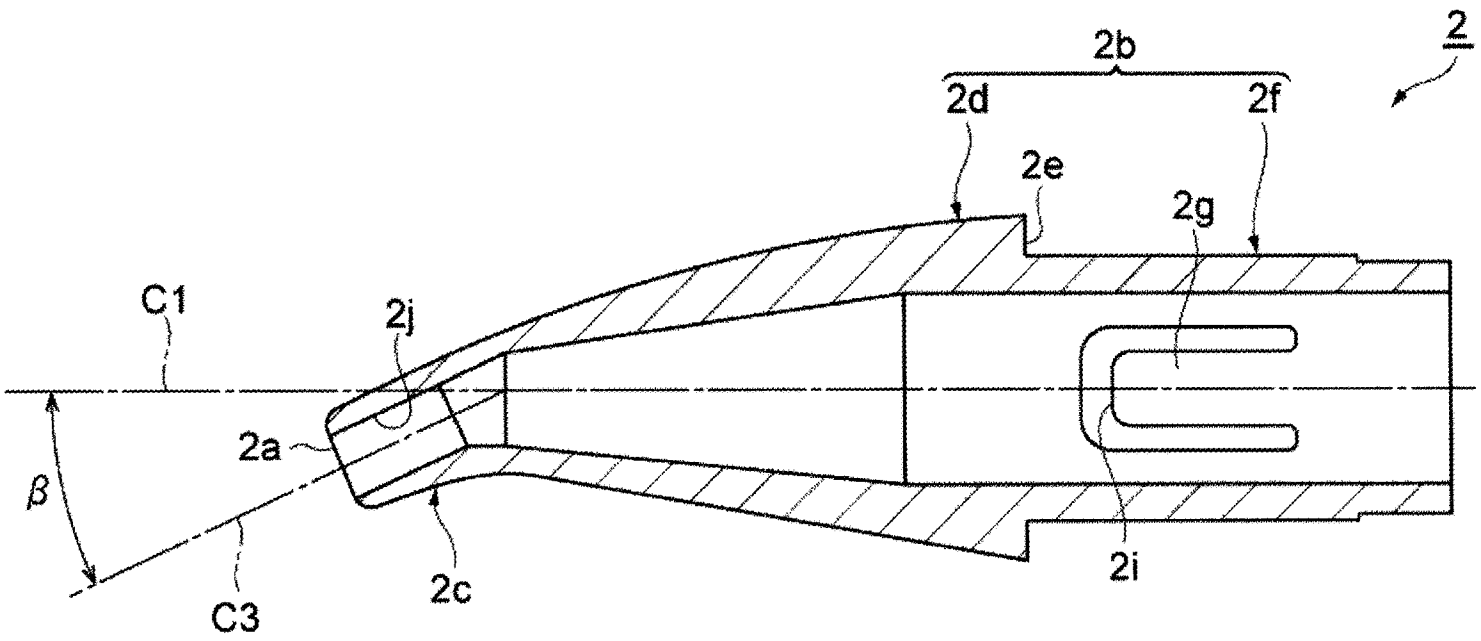
FIG. 5 is an arrow view taken along V-V in FIG. 4.
Figure 6:
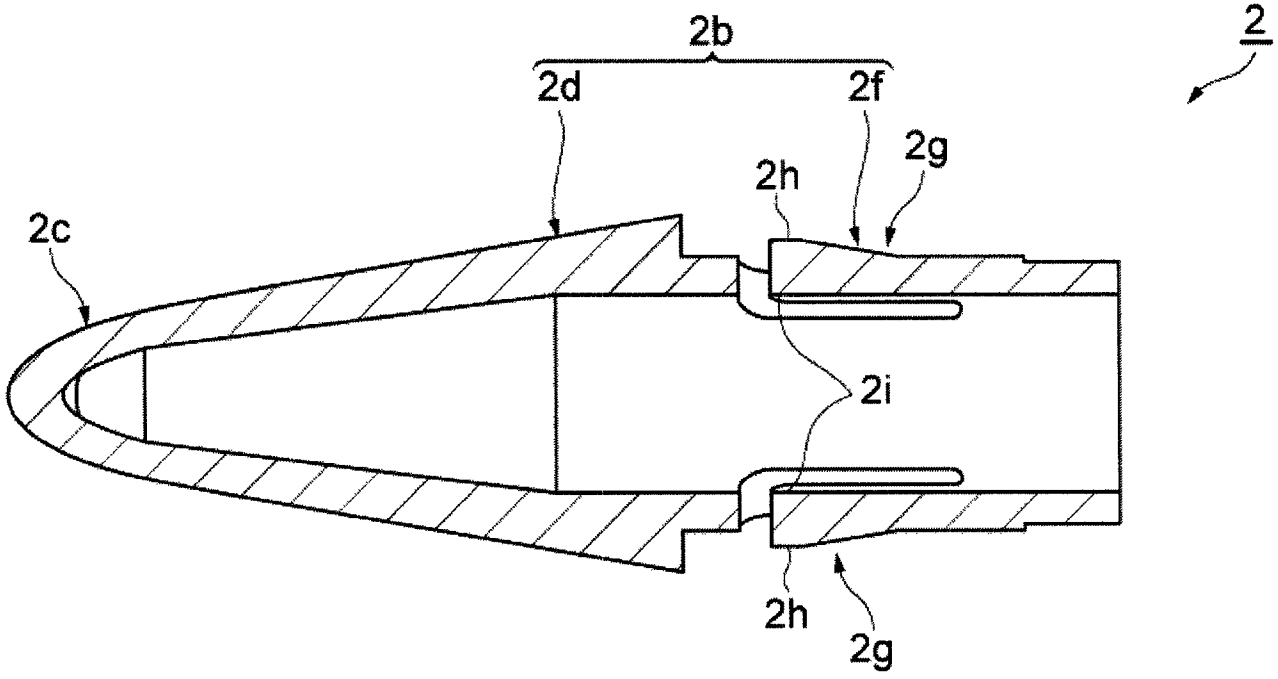
FIG. 6 is an arrow view taken along VI-VI in FIG. 3.
Figure 7:
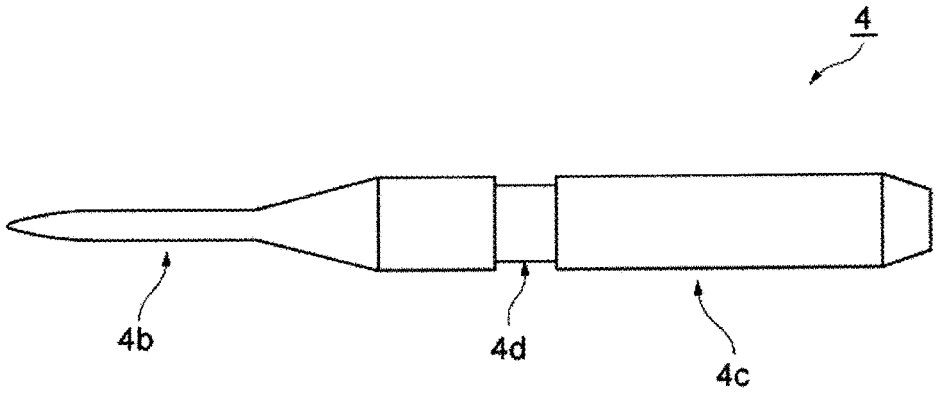
FIG. 7 is a front view illustrating an intermediate core in FIG. 1 before incorporation.

The following describes a preferred embodiment of a liquid cosmetic container according to the present invention with reference to FIG. 1 to FIG. 7. FIG. 1 is a vertical cross-sectional view illustrating the liquid cosmetic container. FIG. 2 is a front view illustrating the liquid cosmetic container in FIG. 1 from which a cap is removed. FIG. 3 to FIG. 6 are drawings each illustrating a leading tube. FIG. 7 is a front view illustrating an intermediate core before incorporation. The liquid cosmetic container of this embodiment is used for an application of a liquid cosmetic material to an applied portion.

As illustrated in FIG. 1 and FIG. 2, a liquid cosmetic container 100 includes a container main body 1 and a leading tube 2, which constitute an outer shape of the container, and as illustrated in FIG. 1, includes an inner cotton 3 housed in the container main body 1, an intermediate core 4, and a cap 5. The intermediate core 4 is housed in the container main body 1 and the leading tube 2 and projects from an opening 2*a*, which is at a tip of the leading tube 2. The cap 5 is removably installed to a tip end side of the container main body 1 to protect an applying portion 4*a* (the details will be described later), which is a tip end part of the intermediate core 4.

The container main body 1 is made of, for example, a PP and is formed into a tapered, stepped cylindrical shape. Installation of a tail plug 6 to the container main body 1 closes an opening at a rear end of the container main body 1. An internal space formed rearward with respect to a stepped portion on an outer peripheral surface of the container main body 1 is configured as a housing portion 1*a* to house the liquid cosmetic material. The housing portion 1*a* is filled with the inner cotton 3 into which the liquid cosmetic material is impregnated. The inner cotton 3 is, for example, made of a polyester. An adjuster 7, which is disposed at a rear end of the inner cotton 3, can adjust a size of the inner cotton 3.

Here, an eyeliner cosmetic material is used as the liquid cosmetic material impregnated into the inner cotton 3, and an eyeliner cosmetic container is used as the liquid cosmetic container as specifically preferable. However, another liquid cosmetic material such as liquid cosmetic material for eyebrow or hair mascara is applicable as the liquid cosmetic material.

Figure 3:
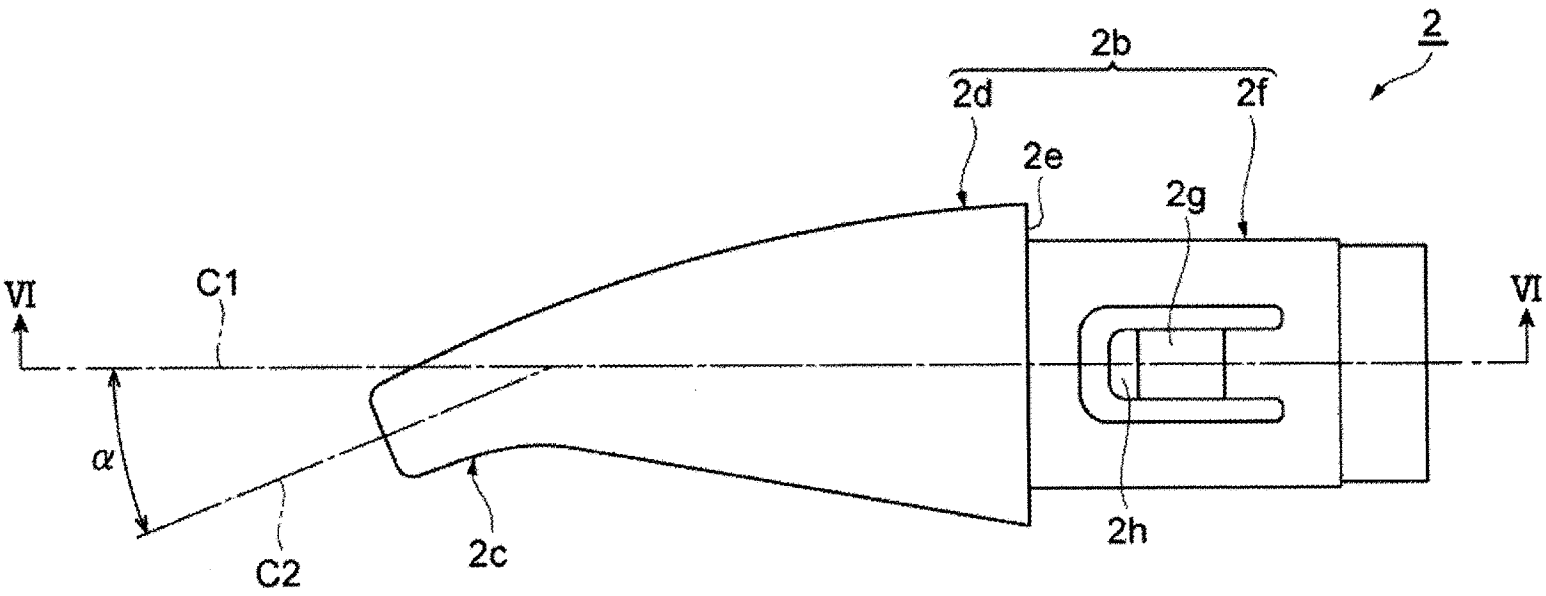
FIG. 3 is a front view illustrating a leading tube in FIG. 1 and FIG. 2.
Figure 4:
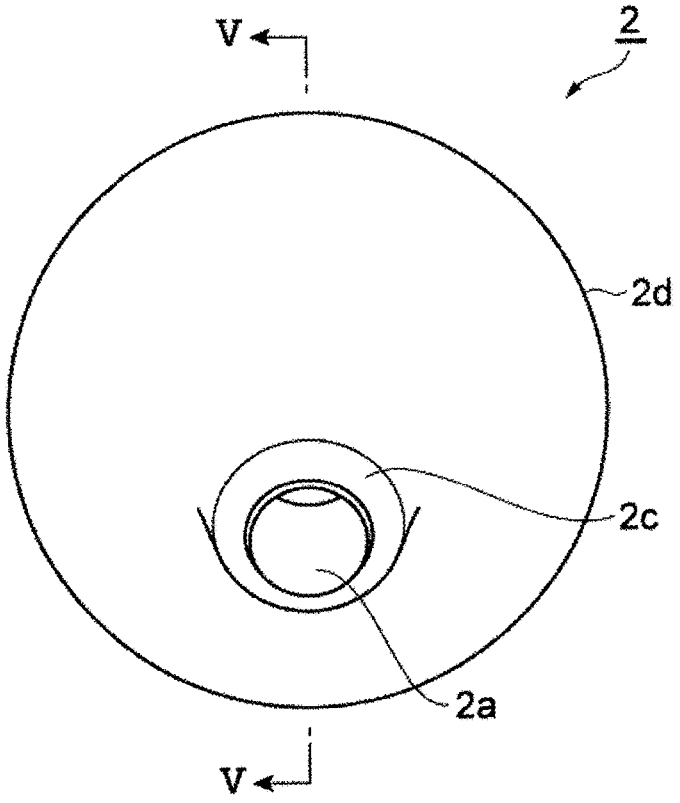
FIG. 4 is a left side view of the leading tube illustrated in FIG. 3.

The leading tube 2 serves as a holder to hold the intermediate core 4. The leading tube 2 is made of the PP or a similar material and is formed into a tubular shape. As illustrated in FIG. 3 and FIG. 5, the leading tube 2 includes a base portion 2*b* and an inclination portion 2*c*. The base portion 2*b* is positioned concentrically with an axis center C1 of the container main body 1 and almost linearly extends. The inclination portion 2*c* inclines so as to curve (so as to bend) from a tip of the base portion 2*b*.

The base portion 2*b* includes a tapered cylindrical portion 2*d* and a small-diameter cylindrical portion 2*f* with small diameter. A cylinder of the tapered cylindrical portion 2*d* is tapered along the axis center C1. The small-diameter cylindrical portion 2*f* is installed consecutively from a rear end of the tapered cylindrical portion 2*d* via a stepped surface 2*e*.

The small-diameter cylindrical portion 2*f* is a part inserted into a tip end part of the container main body 1. As illustrated in FIG. 3, FIG. 5, and FIG. 6, springs 2*g* and 2*g* are disposed at opposed positions on the outer peripheral surface of the small-diameter cylindrical portion 2*f*. The springs 2*g* and 2*g* are cut to have a U shape to communicate with the inside and the outside of the tube, and rear portions of the springs 2*g* and 2*g* are cantilevered. A convex portion 2*h*, which is disposed on a tip end side and outer peripheral side of this spring 2*g*, is a part abutting on an inner peripheral surface of the tip end part of the container main body 1. An end on a tip end side and an inner peripheral side of the spring 2*g* is configured as an engaging end 2*i* to engage the intermediate core 4.

As illustrated in FIG. 3 to FIG. 6, the inclination portion 2*c* with a cylindrical shape inclines and is continuous to the tip of the tapered cylindrical portion 2*d*. An inclination angle of a tube hole 2*j* on the inclination portion 2*c* (an angle formed by the axis center C1 of the container main body 1 and an axis center C3 of the tube hole 2*j* on the inclination portion 2*c*) β illustrated in FIG. 5 is larger than an inclination angle of the inclination portion 2*c* (an angle formed by the axis center C1 of the container main body 1 and an axis center C2 of the inclination portion 2*c*) α illustrated in FIG. 3.

That is, the axis center C3 of the tube hole 2*j* on the inclination portion 2*c* inclines in a direction identical to an inclination direction that the axis center C2 of the inclination portion 2*c* inclines with respect to the axis center C1 of the container main body 1 (downward in the drawing) and further inclines with respect to the axis center C2 of the inclination portion 2*c*.

As illustrated in FIG. 1, the intermediate core 4 is shaft shaped and disposed inside the container main body 1 and the leading tube 2. This intermediate core 4 can develop capillarity. As the intermediate core 4, various intermediate cores such as one formed by polishing process on a synthetic fiber such as an acrylic, a polyester, and a nylon adhered with a resin, one formed by punching process on a sheet-shaped synthetic fiber, and one formed by molding a porous polyurethane with mold are applicable.

As illustrated in FIG. 7, before being incorporated into the leading tube 2, the intermediate core 4 linearly extends along the axis center. A tip end side of the intermediate core 4 extends along the axis center direction as a small-diameter portion 4*b*. A part rearward with respect to this small-diameter portion 4*b* is configured as a large-diameter portion 4*c* with large diameter. A pair of grooves 4*d* opposed to each other are formed in the middle of the large-diameter portion 4*c* in the axis center direction. The engaging ends 2*i* of the leading tube 2 enter the pair of grooves 4*d*.

The intermediate core 4, which is formed of the material as described above and linearly extends, has a property where a bent part of the intermediate core 4 warps so as to recover the original shape through the impregnation of the liquid cosmetic material into the bent intermediate core 4.

As illustrated in FIG. 1, the tip end side of the intermediate core 4 is inserted inside a tube hole on the base portion 2*b* of the leading tube 2. The small-diameter portion 4*b* on the tip end side of the intermediate core 4 is bent (curves) and inclines so as to follow the tube hole 2*j* on the inclination portion 2*c*. The tip end part of the intermediate core 4 projects from the opening 2*a* on the leading tube 2, and this projected part is configured as the applying portion 4*a*. This applying portion 4*a* achieves a function similar to one referred to as a so-called chip.

Before the leading tube 2 incorporating the intermediate core 4 being installed to the container main body 1 housing the inner cotton 3, that is, with the intermediate core 4 not containing (not impregnating) the liquid cosmetic material, the axis center C3 of the tube hole 2*j* on the inclination portion 2*c* (see FIG. 5) matches (is positioned concentrically with) an axis center of the applying portion 4*a* projecting from the opening 2*a* on the leading tube 2. The axis center of the applying portion 4*a* inclines in a direction identical to an inclination direction that the axis center C2 (see FIG. 3) of the inclination portion 2*c* inclines with respect to the axis center C1 of the container main body 1 (downward in the drawing) and further inclines with respect to the axis center C2 of the inclination portion 2*c*. That is, the axis center C2 of the inclination portion 2*c* and the axis center of the applying portion 4*a* are displaced (are not positioned concentrically with each other).

As illustrated in FIG. 1, the small-diameter cylindrical portion 2*f* of the base portion 2*b* is inserted inside the tube hole on the tip end part of the container main body 1, the convex portions 2*h* (see FIG. 6) of the springs 2*g* of the leading tube 2 abut on and are brought into pressure contact with the inner peripheral surface of the container main body 1 with the stepped surfaces 2*e* abutting on the top end surface of the container main body 1. Thus, the leading tube 2 with the intermediate core 4 is installed to the container main body 1. Further, this pressure contact pushes the springs 2*g* to the inside. The engaging ends 2*i* (see FIG. 6) of the springs 2*g* enter the grooves 4*d* (see FIG. 7) on the intermediate core 4, thus installing the intermediate core 4 to the leading tube 2. With this state, the tube hole on the leading tube 2 communicates with the housing portion 1*a* of the container main body 1, and the rear end portion of the intermediate core 4 is positioned inside the housing portion 1*a* and is inserted into the inner cotton 3.

That is, with the liquid cosmetic container 100 illustrated in FIG. 1 and FIG. 2, the intermediate core 4 absorbs up the liquid cosmetic material impregnated into the inner cotton 3 by the capillarity of the intermediate core 4 and sends the liquid cosmetic material to the applying portion 4*a* at the tip, thus impregnating the liquid cosmetic material.

Then, among the intermediate core 4, while the small-diameter portion 4*b* inside the inclination portion 2*c* remains inclined following the tube hole 2*j* on the inclination portion 2*c*, the applying portion 4*a* warps back to attempt to recover the original state before the inclination. The axis center of the applying portion 4*a* approaches the axis center C2 (see FIG. 3) of the inclination portion 2*c* to almost match (concentrically position) the mutual axis centers of the inclination portion 2*c* and the applying portion 4*a*. That is, the liquid cosmetic container 100 illustrated in FIG. 1 and FIG. 2 where the applying portion 4*a* straightforwardly projects so as to be approximately perpendicular to the top end surface of the inclination portion 2*c* while the axis centers of the inclination portion 2*c* and the applying portion 4*a* almost match mutually (are positioned concentrically) is obtained.

With this embodiment, the leading tube 2 on the tip end side of the container main body 1 includes the inclination portion 2*c* inclining to the axis center C1 of the container main body 1. The container does not hinder an application of a makeup while a mirror is seen and therefore an application target is seen easily, ensuring improving usability.

The axis center C3 of the tube hole 2*j* on the inclination portion 2*c* inclines in the direction identical to the inclination direction that the axis center C2 of the inclination portion 2*c* inclines with respect to the axis center C1 of the container main body 1 and further inclines with respect to the axis center C2 of the inclination portion 2*c*. Therefore, when the applying portion 4*a*, which projects from the opening 2*a* on the tip of the leading tube 2, warps to attempt to recover the original state, the axis center of the applying portion 4*a* approaches the axis center C2 of the inclination portion 2*c*. The user can provide the application while seeing the mirror with the axis centers of the inclination portion 2*c* and the applying portion 4*a* approximately matched mutually. This ensures further improving the usability.

While the present invention has been specifically described on the basis of its embodiment, the present invention is not limited to the above embodiment. For example, the embodiment describes the application of the liquid cosmetic container of inner cotton type that houses the inner cotton 3 containing the liquid cosmetic material in the housing portion 1*a* of the container main body 1 and sends the liquid cosmetic material from the inner cotton 3 to the applying portion 4*a* at the tip of this intermediate core 4 through the intermediate core 4. However, the present invention is also applicable to a liquid cosmetic container where the liquid cosmetic material is directly filled to the inside of the housing portion 1*a* and this liquid cosmetic material is supplied to the applying portion 4*a* through the intermediate core 4.

While the embodiment has the configuration in which the leading tube 2 includes the base portion 2*b* and the inclination portion 2*c*, the entire leading tube may be the inclination portion. The leading tube 2 and the container main body 1 may be an integrated product.

The intermediate core 4 including the applying portion 4*a* may be replaced by a configuration such as a writing brush and a brush.

A liquid cosmetic container that pushes out the liquid cosmetic material by a push-out mechanism and a squeeze type liquid cosmetic container such as a tube and a soft bottle that can push out the liquid cosmetic material by a pressing force by the user may be applicable as the liquid cosmetic container.

What is claimed is:

1. A liquid cosmetic container comprising:

a container main body that includes a housing portion that receives a liquid cosmetic material therein;

a leading tube having a tubular shape, and a main body that has a longitudinal axis that extends substantially parallel to a longitudinal axis of the container main body, the leading tube being positioned on a tip end side of the container main body, the leading tube having a tube hole communicating with the housing portion;

an intermediate core disposed in the container main body and in the leading tube, the intermediate core conveying the liquid cosmetic material; and a tubular cover having an outer circumference substantially the same as an outer circumference of the housing portion, wherein:

a rear end of the intermediate core is positioned inside the housing portion, a tip of the intermediate core projecting from a tip opening provided at a tip of the leading tube, the tip of the intermediate core comprising a liquid cosmetic material applying portion, the leading tube has an inclination portion at a frontmost tip end, the inclination portion being inclined with respect to an axial center of the container main body, the intermediate core inclines following a tube hole on a frontmost end of the inclination portion, an axial center of the tube hole on the inclination portion extends in a direction identical to an inclination direction that an axial center of the inclination portion inclines with respect to the axial center of the container main body and further inclines with respect to the axial center of the inclination portion, and the inclination portion is contained within the tubular cover.

2. The liquid cosmetic container according to claim 1, wherein the inclination portion of the leading tube comprises an inclined portion extending from a main body of the leading tube, and the tube hole is provided at a tip end of the leading tube.

3. The liquid cosmetic container according to claim 1, the frontmost tip end of the inclination portion of the leading tube being inclined along a direction of inclination that diverges from a longitudinal axis of the container main body.

4. The liquid cosmetic container according to claim 1, a longitudinal axis of the tubular cover being substantially aligned with a longitudinal axis of the housing portion.

5. A liquid cosmetic container comprising:

a container main body that includes a housing portion that receives a liquid cosmetic material therein;

a leading tube having a tubular shape, the leading tube being positioned on a tip end side of the container main body, the leading tube having a tube hole communicating with the housing portion; and an intermediate core disposed in the container main body and in the leading tube, the liquid cosmetic material absorbed within the intermediate core by a capillarity of the intermediate core, the intermediate core transmitting the liquid cosmetic material toward a tip of intermediate core, wherein:

a rear end of the intermediate core is positioned inside the housing portion, the tip of the intermediate core projecting from a tip opening provided at a tip of the leading tube, the tip of the intermediate core comprising a liquid cosmetic material applying portion, and the tip of the intermediate core comprising a small diameter portion having a diameter smaller than a diameter of a large diameter portion provided rearwardly with respect to the small diameter portion, the leading tube has an inclination portion at a frontmost tip end, the inclination portion being inclined with respect to an axial center of the container main body, the small diameter portion of the tip of the intermediate core has a bent portion and is inclined to extend in a direction in accordance with a direction of a tube hole provided on a frontmost end of the inclination portion, an axial center of the tube hole on the inclination portion extends in a direction identical to an inclination direction that an axial center of the inclination portion inclines with respect to the axial center of the container main body and further inclines with respect to the axial center of the inclination portion.

6. The liquid cosmetic container according to claim 5, wherein the leading tube has a main body that has a longitudinal axis that extends substantially parallel to a longitudinal axis of the container main body.

7. The liquid cosmetic container according to claim 5, wherein the inclination portion of the leading tube comprises an inclined portion extending from a main body of the leading tube, and the tube hole is provided at a tip end of the leading tube.

8. The liquid cosmetic container according to claim 5, the frontmost tip end of the inclination portion of the leading tube being inclined along a direction of inclination that diverges from a longitudinal axis of the container main body.

9. A liquid cosmetic container comprising:

a container main body that includes a housing portion that receives a liquid cosmetic material therein;

a leading tube having a tubular shape, the leading tube being positioned on a tip end side of the container main body, the leading tube having a tube hole communicating with the housing portion;

an intermediate core disposed in the container main body and in the leading tube, the intermediate core conveying the liquid cosmetic material; and a tubular cover having an outer circumference substantially the same as an outer circumference of the housing portion, a longitudinal axis of the tubular cover being substantially aligned with a longitudinal axis of the housing portion wherein:

a rear end of the intermediate core is positioned inside the housing portion, a tip of the intermediate core projecting from a tip opening provided at a tip of the leading tube, the tip of the intermediate core comprising a liquid cosmetic material applying portion, the leading tube has an inclination portion at a frontmost tip end, the inclination portion being inclined with respect to an axial center of the container main body, the intermediate core inclines following a tube hole on a frontmost end of the inclination portion, an axial center of the tube hole on the inclination portion extends in a direction identical to an inclination direction that an axial center of the inclination portion inclines with respect to the axial center of the container main body and further inclines with respect to the axial center of the inclination portion, and the inclination portion is contained within the tubular cover.

* * * * *